US005123762A

United States Patent [19]

McCartney

[11] Patent Number: 5,123,762

[45] Date of Patent: Jun. 23, 1992

[54] SPLIT TRACTOR CLAMP FOR AN IMPACT PRINTER

[75] Inventor: Kenneth C. McCartney, Irvine, Calif.

[73] Assignee: Printronix, Inc., Irvine, Calif.

[21] Appl. No.: 647,246

[22] Filed: Jan. 29, 1991

[51] Int. Cl.[5] ..... B41J 11/26; B65H 20/20

[52] U.S. Cl. ..... 400/616; 400/616.1; 226/74

[58] Field of Search ..... 400/616-616.3; 226/74, 75, 170-173; 352/183

[56] References Cited

U.S. PATENT DOCUMENTS 4,787,545 11/1988 Yasumi ..... 400/616.2
4,804,124 2/1989 Hirth et al. ..... 400/616.2
4,836,431 6/1989 Hirth et al. ..... 400/616.1

FOREIGN PATENT DOCUMENTS 2163705 3/1986 United Kingdom ..... 400/616.1

OTHER PUBLICATIONS

"Convenient Loading Paper Feed with Separator Bar", IBM Tech. Discl. Bulletin, vol. 24, No. 11A, Mar. 1982 p. 5478.

*Primary Examiner*—Eugene H. Eickholt
*Attorney, Agent, or Firm*—George F. Bethel; Patience K. Bethel

[57] ABSTRACT

A printer tractor drive assembly is specified having a belt with pins which engage paper which is to be moved across a print station. The assembly includes a split lid covering the paper being driven. One portion of the split lid can be opened to expose and remove the paper along its perforations, while the other portion of the split lid retains the paper on the tractor pins.

6 Claims, 4 Drawing Sheets

SPLIT TRACTOR CLAMP FOR AN IMPACT PRINTER

FIELD OF THE INVENTION

The field of this invention lies within the field of impact printers. Specifically, it lies in the field of impact printers wherein a multiplicity of impact heads are released from a shuttle which reciprocates across the face of paper to be printed upon. The paper that is to be printed upon is driven by a tractor drive belt having a number of drive pins which engage the paper that has been provided with holes. The tractor having the drive pins allows the paper to be fed therethrough and removed by means of perforations within the paper.

BACKGROUND OF THE INVENTION

The prior art pertaining to impact printers incorporates the utilization of a tractor drive assembly. The tractor drive assembly has a number of pins which drive a continuously connected sheet of perforated fanfold paper. Along the edge of the fanfold paper are a plurality of openings which have been punched in the edge of the paper. The openings are received over a series of pins on the tractor belt. As the tractor belt moves, the pins engage the openings in the edge of the paper and drive it. As the paper is being driven, the impact printer shuttle moves backwardly and forwardly across the paper to allow the impact hammer tips to imprint upon the paper through means of an ink ribbon.

Easy removal of the paper or document that has been printed upon from the tractor prior to the document exiting the tractor, has not been accomplished to date. Fundamentally, the paper has to travel completely through the printer and then be removed by tearing it along the perforations in the fanfolds of the paper. This causes a waste of paper. Oftentimes, that which is to be printed only has a minimum number of lines. If the paper can not be removed until it has travelled completely through the tractor and in most cases through the printer itself, it creates inefficiencies and waste.

This problem necessitates an excess use of paper, as well as creating operator difficulties. The invention hereof overcomes the difficulties of the prior art by allowing removal of the paper prior to the document exiting the tractor. This is done by opening an upper lid independently so that the document or paper can be removed from the printer while it is closer to the print station. The conformation of the invention is in the form of a split tractor clamp or lid. The lower lid maintains the drive pin engagement with the paper drive holes or openings in the side of the paper. The foregoing preserves the paper alignment in its proper location.

With both lids closed, a full complement of drive pins drives the paper in the openings along the edge. The upper lid and lower lid guide and support the paper in the same manner as a conventional single lid tractor. However, when opening the combined lid by pulling on the lower lid, the split tractor lid functions as a single lid. They open by virtue of the lower lid serving to engage the upper lid. This is caused by a lip between the upper and lower lids engaging one another so that the upper and lower lids open simultaneously when the lower lid is pulled open.

The features and objects of the invention in part reside in a lower tractor lid which is sufficiently large enough to maintain tractor pin engagement with the paper drive holes.

Another feature is to provide an upper access lid that can function independently from the lower lid. This provides for independent removal of shortened paper lengths by tearing the paper along perforations in the fanfold paper.

Another object and feature of the invention is to provide a commonly hinged access for both lids so that each lid can operate independently or together. To enhance this operation, a spring or other device to hold the lids in closed relationship is provided.

A magnet spring latch or other device can hold the upper lid closed, and/or can be attached to the lower lid to provide for securement thereof.

The functions of the split lid of the tractor will be appreciated when the description hereinafter is seen in light of the drawings as to its configuration and function.

SUMMARY OF THE INVENTION

In summation, this invention comprises a split tractor clamp or lid for an impact printer.

The split tractor lid specifically provides for maintenance of paper between the lid and the tractor pins. The maintenance of the paper is retained in a close and well indexed manner.

The split tractor lid allows for removal of a document such as a form, label, file card, etc. from the tractor prior to the document exiting the tractor. Thus, abbreviated forms, labels, file cards and other documents that are perforated and of nominal size, can be removed without the entire document exiting from the tractor. The foregoing is enhanced by independently opening the upper lid so that the document can be removed from the printer while it is closer to the print station. The lower lid in turn maintains the drive pins in the paper drive holes, thus preserving the paper alignment in its proper location.

When both lids are closed, a full complement of tractor drive pins drive the paper. As stated previously, they move the paper in a well indexed and discrete manner.

Further to the operation of the invention, the upper lid guides and supports the paper in the same manner as a conventional single lid tractor. When the tractor lid is opened while pulling on the lower lid, the split lid functions as a single lid opening the upper and lower lid simultaneously.

Summarily stated, the tractor lid is an enhanced configuration, tractor lid and cover assembly, to provide access and well indexed orientation of paper that is to be printed and removed in a more discrete manner than is known in the prior art. These features will become more apparent in the following specification, as taken in conjunction with the accompanying drawings.

BRIEF DESCRIPTION OF THE DRAWINGS

The invention will be more clearly understood by reference to the description below taken in conjunction with the accompanying drawings wherein.

DETAILED DESCRIPTION OF THE SPECIFICATION

Figure 3:
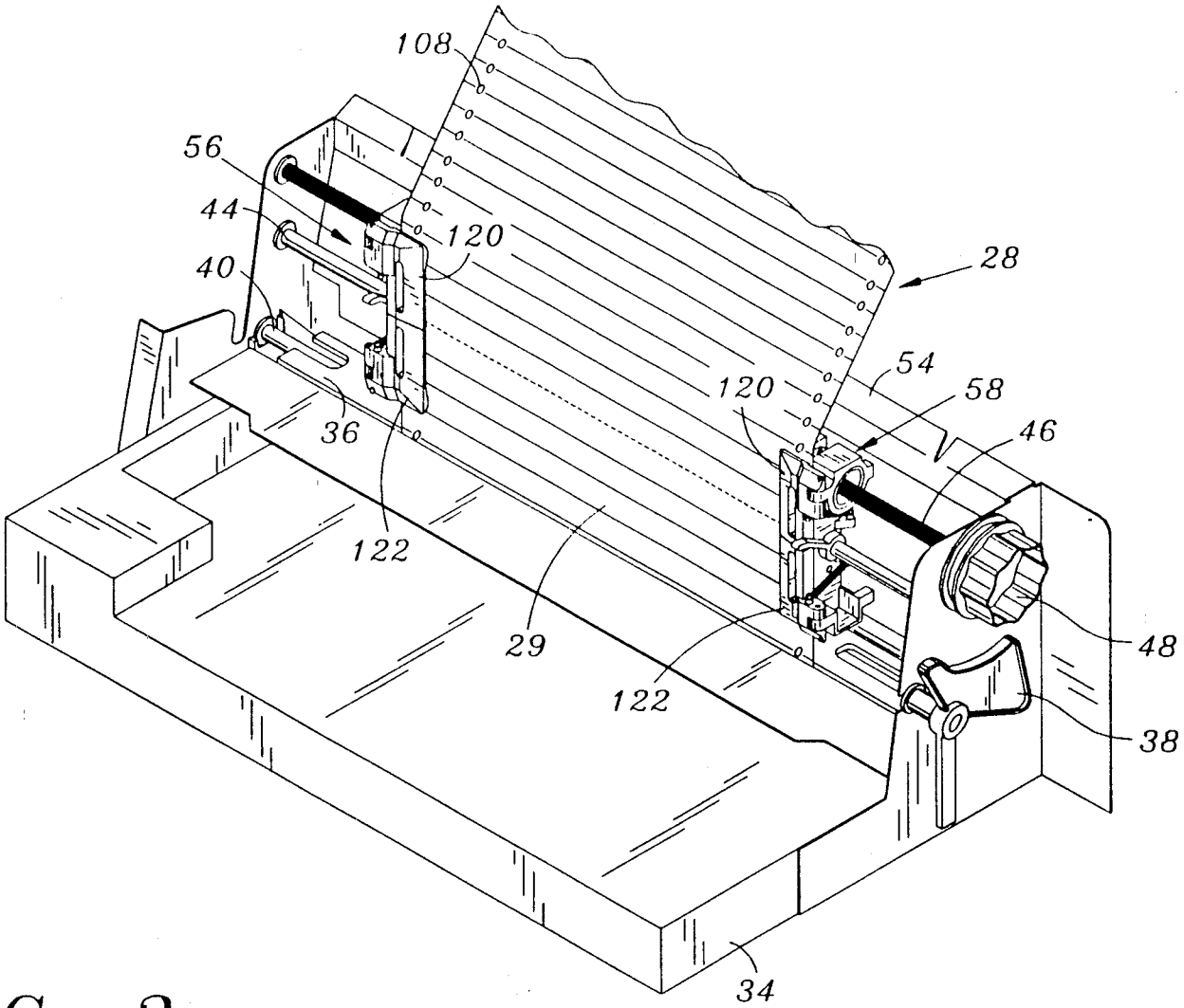
FIG. 3 is a perspective view of an impact dot matrix printer of this invention showing the split tractor lids in position holding the paper as it moves through the tractors.
Figure 4:
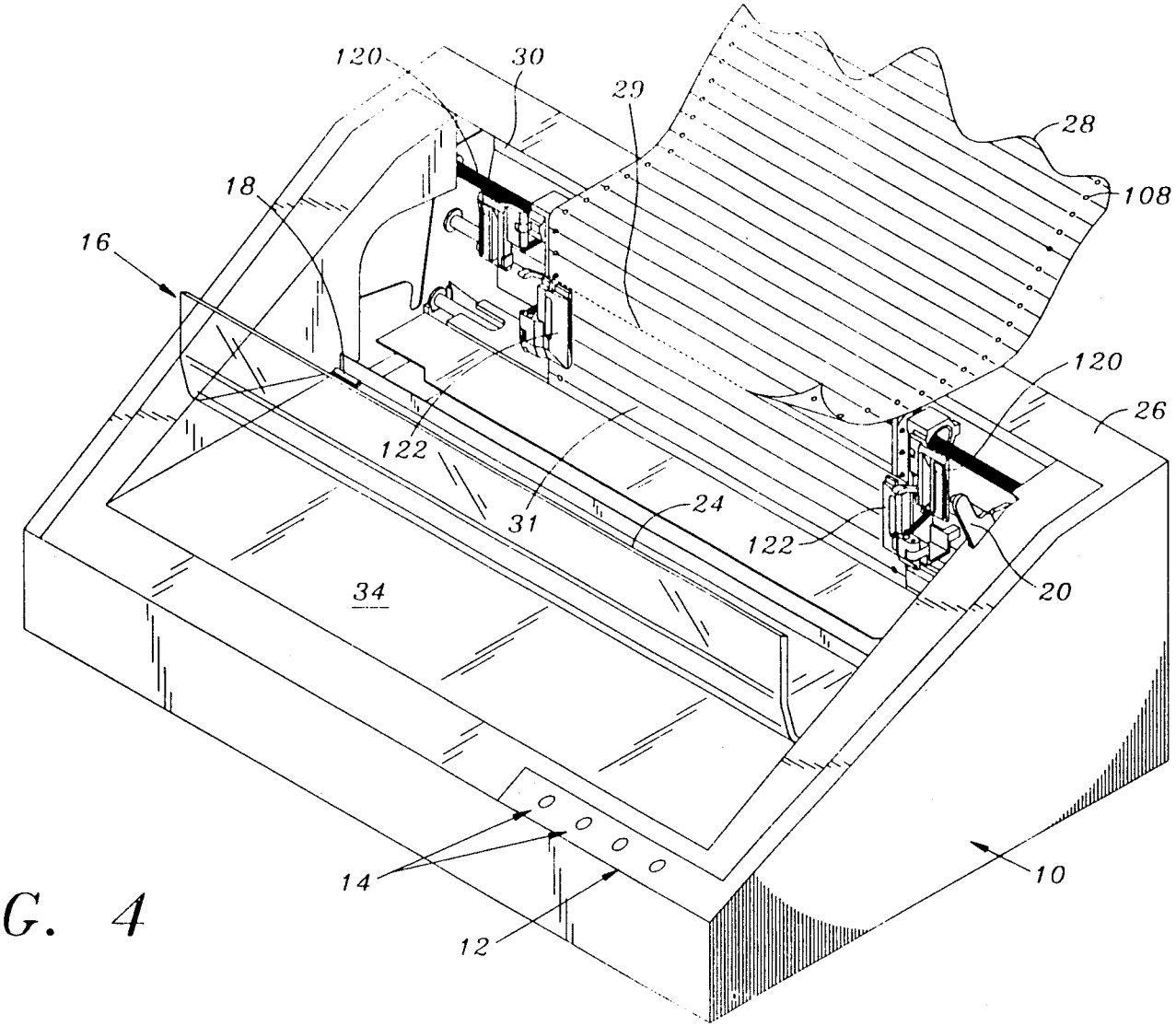
FIG. 4 shows a cover of the dot matrix printer with the clear access window or cover open, and the tops of the split tractor open to allow removal of a portion of the paper along the perforations thereof.

Looking specifically at FIG. 4, it can be seen that a printer lid or cover 10 has been shown. The printer lid or cover 10 is of a configuration wherein it overlies the top of the printer assembly. The printer assembly incorporates the dot matrix printer that shall be detailed more specifically hereinafter with respect to FIG. 3. The printer cover 10 has a control panel 12 shown with a number of pushbuttons and indicators 14. These pushbutton indicators operate the printer in the normal manner as all dot matrix printers are operated.

In order to gain access to the paper being handled by the printer, a clear access window 16 is shown. The clear access window is in the form of a pivotal lid or cover having pintals or a pivotal hinge point at hinge pins 18.

A camming lever 20 is shown which cams the lid or cover 16 into an open, partially opened, or closed position. The lid or cover 16 can be allowed to be nominally opened when lifting the clear access window to provide passage of the paper through a space between the edge of the clear access window 24 forming the cover 16 and the top rear surface 26 of the cover. In particular, it provides for movement of paper such as that shown as paper 28 over the edge 30 of rear panel 26, in an unhampered manner between it and the edge of the clear access window, namely edge 24.

Looking more particularly at FIG. 3, it can be seen that some of the details of the interior of the printer, which is a line printer, have been shown. In particular, an interior cover 34 has been shown. The interior cover 34 overlies the interior mechanism of the printer and the base upon which it resides.

In order to provide for line printing, a platen 36 is shown. The platen 36 has a platen adjustment lever 38 which is known in the art. The platen adjustment lever allows for the movement of the platen to a specific orientation with respect to the paper that is to be printed by the hammer bank tips.

A platen support shaft 40 allows the platen to be supported and properly journaled as to its orientation with respect to the paper and with regard to the platen adjustment movement through the lever 38, so that line printing can be effectuated.

In order to provide for support of the paper and in particular the tractor and lids of this invention, two well known printer shafts are shown. A first shaft is in the form of a stationary or dead shaft 44. The stationary shaft 44 allows for the tractors as described hereinafter to move inwardly and outwardly thereon for lateral adjustment with respect to the paper 28.

A second shaft in the form of a splined shaft 46 is shown. The splined shaft 46 supports the tractors and allows them to be driven by the splines thereof.

In order to adjust the paper and move it through movement of the splined shaft 46, a paper advance knob 48 is shown which allows the splined shaft 46 to be rotated. Rotation of the splined shaft 46, by hand movement of the knob 48 or when mechanically driven, allows the paper 28 to be advanced.

In order to allow the paper 28 to be driven, the tractors have pins which shall be set forth hereinafter, that engage the paper. In order to cover the rear of the printer a dress panel 54 is shown. The dress panel 54 allows for a covering and maintenance of the upper portion of the panel and cover 34 to be retained in an asthetically pleasing manner and to eliminate dust and particles from being dropped into the printer mechanism.

As can be seen in FIGS. 3 and 4, the paper 28 has been shown moving through the tractors. Specifically, a lefthand tractor 56 and cover or lid has been shown and a righthand tractor 58 and cover or lid has been shown. These respective tractors are mounted on the stationary or dead shaft 44 at their bottom portions and on the splined shaft 46 in their upper portions.

Figure 1A:
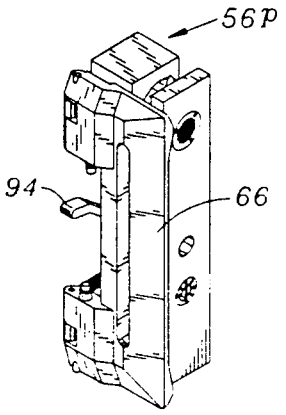
PRIOR ART FIG. 1a
FIG. 1*a* is a perspective view of a tractor and lid assembly of the prior art.
Figure 1B:
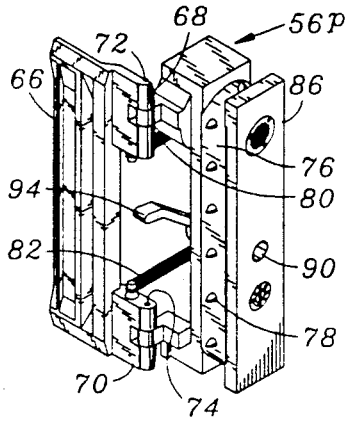
PRIOR ART FIG. 1b
FIG. 1*b* is a tractor and lid assembly of the prior art as shown in FIG. 1*a* with the unified lid in its opened position exposing the pins of the tractor belt.
Figure 2A:
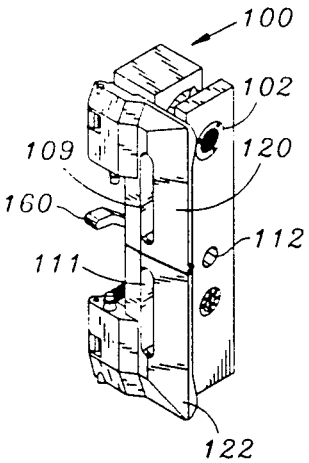
FIG. 2*a* is a perspective view of the tractor and split lid of this invention in its closed configuration.
Figure 2B:
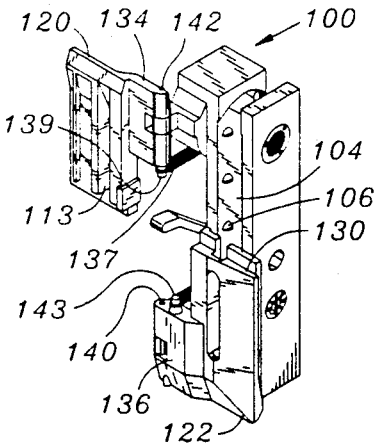
FIG. 2*b* is a showing of the tractor and split lid configuration with the top portion of the split lid opened.
Figure 2C:
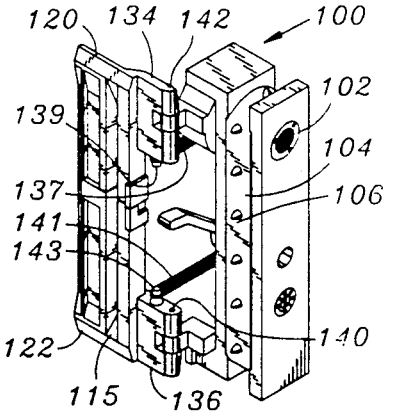
FIG. 2*c* is a perspective view of the tractor and split lid of this invention with the bottom and top lid opened by means of the bottom lid being pushed in a manner to engage the top lid along the lip thereof and open both simultaneously.

In order to understand the characteristics of the invention as shown, a review of FIGS. 1 through 2 should now be looked at. In particular, a lefthand tractor **56*p*** with its cover or lid is shown in FIG. 1*a* of the prior art. The tractor **56*p* shows a tractor and cover having a unitized lid 66. The unitized lid 66 is hinged by means of an upper hinge 68 and a lower hinge 70. The two respective hinges are provided by means of a hinge on a hinge point of the tractor supported by an upper pin 72 and a lower pin 74. The prior art tractor and lid 56*p* has a drive belt 76 with drive pins 78**.

In order to allow the lid or cover 66 to be moved, an overcenter spring movement in the form of an upper coil spring 80 and a lower coil spring 82 are shown. These springs provide for an overcenter lid movement action.

The mounting of the prior art tractor and lid assembly **56*p* is by means of an opening with a drive sprocket 86 that is mounted on the splined shaft 46. A lower opening 90 receives the dead shaft or stationary shaft 44** that is placed therethrough to allow for sliding movement along the length thereof.

In order to lock the prior art tractor body and assembly **56*p* on the stationary shaft, a cam lock that is operated with a lever 94 is shown. This lever 94 allows for a clamping along the stationary shaft 44 so that the body of the prior art tractor and lid assembly will not slide in an unwarranted manner such that it will be out of index with the paper 28** which it is to drive.

In viewing the prior art shown in FIGS. 1*a* and 1*b*, a review of the drawings will bring to one's attention the fact that the entire tractor lid or cover must be opened, thereby releasing the paper in order to allow for a perforated tear. Prior art operation is such that to avoid improper indexing of the paper 28, the paper is allowed to be fed through the rear of the cover and outwardly over the dress panel. The paper 28 passes through an opening under the cover rear panel 26 (i.e. under the lip 30 of the panel and outwardly). The paper 28 can then be pulled and separated along perforations 29.

Generally, opening the pivotal cover 16 for document removal is not utilized, inasmuch as it creates a situation which allows for disorientation of the paper on the respective pins and tractor. Thus, small discrete documents can not be torn along a perforated line and disassembled. The best that can be done is to allow them to be fed outwardly and to create a situation wherein the entire paper must be removed in large quantities.

Looking more specifically at FIGS. *2a*, *2b* and *2c*, it can be seen that an alternative to the foregoing problem has been presented in the form of this invention.

In particular, FIG. *2a* shows a tractor body 100 of this invention. The tractor body 100 of this invention incorporates a body portion mounting a tractor drive sprocket 102. The tractor drive sprocket 102 allows for movement of a tractor belt 104 seen more readily in FIGS. *2b* and *2c*. The tractor belt 104 has pins 106 thereon which receive openings 108 in the paper 28.

In order to accommodate the pins 106, longitudinal openings or channels 109 and 111 are utilized in the lids. The interior or each channel can be seen with its interior facing openings 113 and 115. These provide clearance to the pins 106 to allow them to move under the lids which are placed thereover.

The tractor body 100 also has a round opening 112 which is mounted on the stationary shaft. This allows for orientation and indexing of the tractor body so that it will slide laterally and along the longitudinal length of the splined shaft 46 and the stationary shaft 44.

In contradistinction to the prior art lid or cover 66, it can be seen that a pair of split lids or covers 120 and 122 are shown. These split lids respectively can be opened wherein the top split lid 120 is opened independently of the bottom split lid 122 as shown in FIG. *2b*. They can also be opened simultaneously by the bottom lid 122 having an underlying lip 130 engage the overlying portion of the upper lid 120, allowing both lids 120 and 122 to open simultaneously.

The two respective lids are hinged by hinges 134 for the upper lid 120 and 136 for the lower lid 122. These respective hinges 134 and 136 are secured by pins. One of the pins securing the hinge 136 to the lower lid 122 can be seen in the form of pin 140. Also, a pin 142 can be seen securing the upper hinge 134 attached to the upper lid 120. A coil spring 137 is used to bias the lid or cover 120 into its opened or closed position. It is mounted to the lid 120 by means of a pin 139. A lower coil spring 141 is also mounted on the lower lid or cover 122. It is secured to the lid or cover 122 by a pin 143. The springs 137 and 141 are secured to the tractor body at a portion thereof by similar pins so that spring loading and extension can take place by the springs moving in tension for pivotal overcenter latching of the lids 120 and 122.

In order to lock the tractor body 100 in relationship to its location along the shafts, a lever 160 has been shown. The lever 160 causes a cam movement to clamp down on the stationary shaft 44 holding the body 100 in its fixed location therealong.

One revolution of the tractor drive sprocket should advance the paper approximately 2.5 plus or minus 0.005 inches on a non-accumulative basis. The torque required to rotate the spline coupling or drive sprocket 102 should be two to three inch ounces.

The support shaft bushing has a lever 160 actuated locking device that prevents movement of the tractor along the axis of the drive and support shafts 44 and 46. The locking device should check movement of the tractor relative to a 0.310 to 0.312 diameter support shaft when a force of 3.5 pounds is applied to the center parallel to the support shaft 44 axis.

The lever 160 can be used to lock in the upward or downward position and unlock in the position perpendicular to the plane established by the splined and support shafts respectively 46 and 44. The lever 160 should also be accessable to the operator when the hinged portions of the tractors are in a fully closed or open position.

There should be phasing or timing marks on the drive pulley tractor body so that the lefthand and righthand tractor bodies as shown in the form of tractors 56 and 58 are mechanically in phase with the drive shaft. The pins 106 should engage the print paper with a minimum of five pins.

The hinged portion of the tractors, namely upper and lower lids 120 and 122 should open 160° to 200° to load print paper into the printer. They should be spring loaded in the open and closed positions by springs 137 and 141.

The tractor belt 104 should be provided with a belt tensioning device which allows a maximum tangential belt play of 0.005 with a force of plus or minus 2 ounces applied at the base of a pin 106.

The profile of the pins 106 should be smooth and allow disengagement of the pins from the sprocket feed holes 108 in a smooth manner. In this manner, the tractor body 100 can feed the forms without tearing or separating them along the perforations 29.

The drive sprocket 102 should be supported by means of needle bearings or other bearing elements so that it moves in a facile manner to prevent binding or undue loads on the splined shaft 46.

Figure 5:
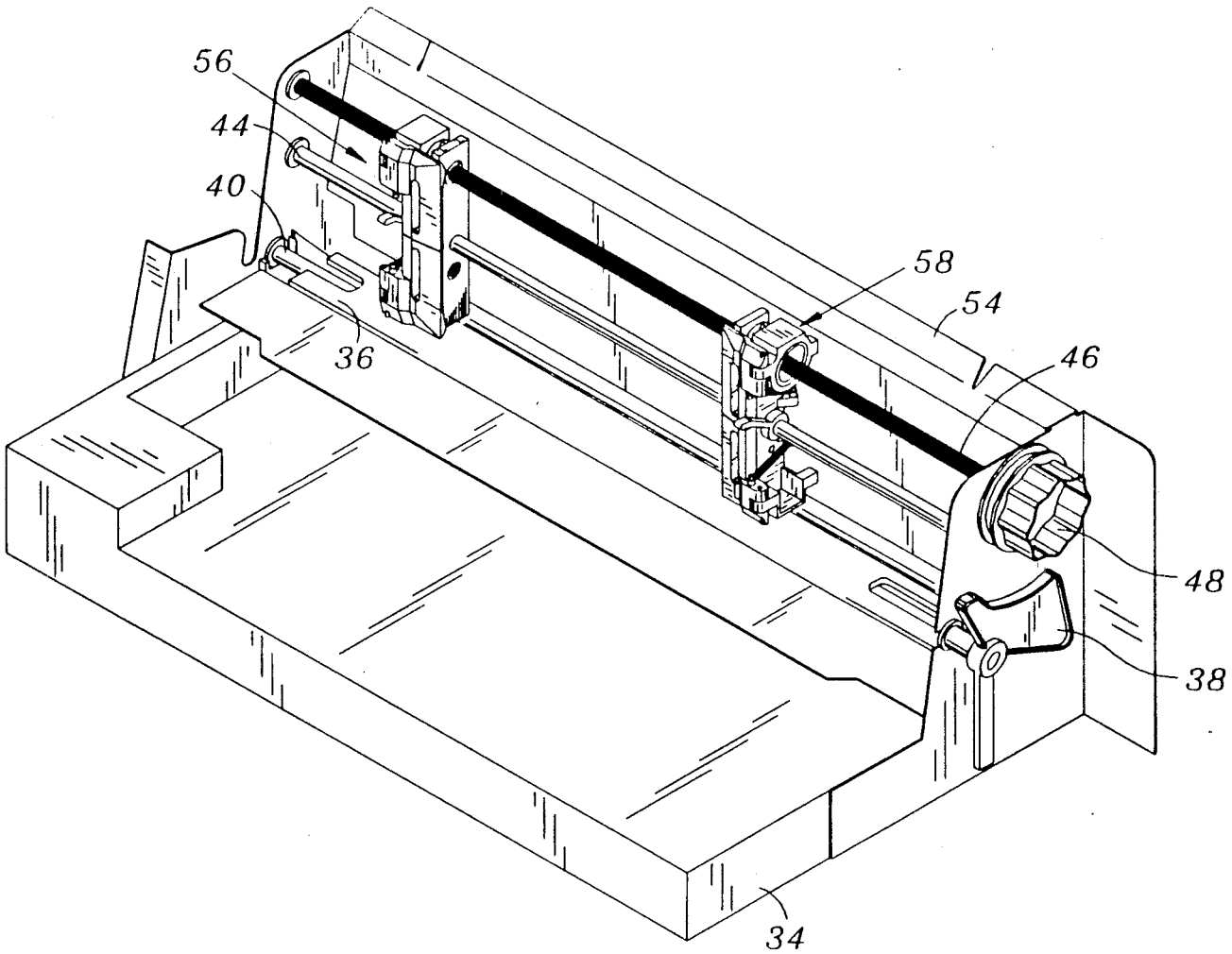
FIG. 5 shows the split tractors in their location on the splined and stationary shafts upon which they are mounted.

As can be seen more particularly in FIG. 5, the cover and mechanism shown in FIG. 3 has been shown without the paper. This gives a clear showing of the actual device without paper passing therethrough, but in all other respects it is the same as that shown in FIG. 3.

Looking more particularly at FIG. 4, it can be seen wherein the lefthand split tractor 56 and righthand split tractor 58 have had their respective upper lid portions 120 opened. In this manner, the paper 28 along the perforated line 29 can be torn. As it is torn along the perforation 29, the bottom portion of the paper 31 is secured by the lower lids 122 of the split tractor 100. In this manner the lids or cover 122 clamp the paper or form 28 onto the pins 106 shown on the belt 104. This allows removal of the paper 28 in a facile manner avoiding the requirement of having to feed a full amount of paper beyond the upper panel 26 in order to tear the paper 28 along the perforation 29. If this lower lid 122 clamping were not undertaken, the paper 28 could not be removed in a facile manner. It would be held in place by the overlying tractor lid such as prior art lid 66, or displaced when the lid of the prior art tractor is opened.

When looking at FIG. 3, it can be seen that the upper tractor lids, namely lids 120, have been shown in their closed orientation. This allows the movement of the paper 28 in the normal manner. As can be appreciated, both lids 120 and 122 can be opened up to allow for complete access and feeding of the paper 28 with the openings 108 being fed over the pins 106 to provide for indexing and orientation thereof. This is merely accomplished by opening the bottom lid 122 which has the lip 130 engaging the underside of the top lid 120 so that they open simultaneously and allow full access to the pins 106.

Summarily stated, this invention allows for the lids 120 and 122 to remain closed so that the paper 28 can be fed outwardly of the printer to the back of the cover 10 underlying rear panel 26. It also allows for the tearing and removal of the paper along the perforations 29 at the extrinsic point in back of the cover 10.

Enhanced operation for small labels and documents is provided by removal along the perforation 29. This is accomplished by means of the clear access panel or cover 16 being moved backwardly. It can then be supported either in its fully opened position as shown in FIG. 4, or supported in a partially opened position by the cam lever 20 so that the paper can pass outwardly along the upper surface of the panel 26. Removal of the abbreviated documents or labels can then be done by merely opening the hinged covers 120 to allow for tearing of the paper 28 along perforation 29 as shown in FIG. 4. This enables the user to accommodate smaller documents while at the same time maintaining the indexing and holding by the tractor.

The tractor can be used with all types of impact printers wherein perforated fan folded paper is moved by pins engaging holes along the edge of the paper. Such printers include various line printers of the type described, as well as dot matrix and serial dot matrix printers incorporating like paper driven by pins on a tractor.

From the foregoing specification, it can be seen that this invention has broad application to printers and should be read as such in light of the following claims.

I claim:

1. In a printer having means for printing on paper which is advanced across the print means, including drive means having pins on a continuous tractor driven by a printer shaft, which engage openings in the paper that is to be driven with means for adjusting said driving means so as to engage said paper proximate the edges thereof and lid means for overlying said paper in engagement with said driving means wherein said lid portion means is formed of at least two portions, the first of which can be opened independently of a second lid portion to remove paper from said drive means while said paper is being held at least in part by said second lid portion, wherein the improvement comprises:

said first lid means comprising a first lid portion that is spring loaded for holding said lid portion in overlying relationship to said tractor;

said second lid portion underlies in part said first lid portion; and, wherein both lid portions are hinged on an axis that is parallel to each other so that when said second lid portion is opened, it can lift and disengage said first lid portion from its overlying relationship with said tractor.

2. A line dot matrix printer comprising a printing means for providing a line dot matrix printing of paper moving across said printing means, a stationary shaft extending across said printer, a splined shaft extending across said printer that is driven for rotational movement a paper support means comprising a tractor body mounted on said stationary shaft and said splined shaft having a tractor belt with pins thereon for engaging holes in the paper that is to be printed upon, said tractor belt connected for movement in response to the rotational movement of said splined shaft wherein the improvement comprises:

lid means for overlying said paper as it is engaged by said pins having a first portion and a second portion with a portion of each lid portion engaging the other and hinged along a common axis; and, means for biasing said first and second portions into overlying engagement with said paper.

3. The printer as claimed in claim 2 wherein:

said second portion underlies at least in part said first portion.

4. The printer as claimed in claim 3 further comprising:

spring biasing means for holding said tractor lids into respective overlying relationship to the paper.

5. An improved tractor assembly for a dot matrix printer for moving paper engaged by said tractor assembly having a continuous tractor with pins for engaging holes in said paper wherein the improvement comprises:

lid means in an overlying relationship to said tractor having a first and second portion wherein one of said portions has a lip means engaging the other portion; and, wherein each portion has a hinge point in parallel with the other and spring biasing means for holding at least one of said lid portions into engagement overlying said tractor so that one or both of said lid portions can be moved from overlying said tractor, and wherein one of said lid portions engaging the other of said lid portions can move them simultaneously along their hinge points.

6. The improved tractor assembly as claimed in claim 5 wherein:

said lid portions are hinged along a common axis in the direction of movement of said tractor.

* * * * *